US008075465B2

(12) United States Patent
Verfaellie et al.

(10) Patent No.: US 8,075,465 B2
(45) Date of Patent: Dec. 13, 2011

(54) ROLLER ASSEMBLY WITH AN ECCENTRIC EXPANDABLE COVER RETAINING RING AND A METHOD OF MANUFACTURING THE ROLLER ASSEMBLY

(75) Inventors: Paul Verfaellie, Deurle (BE); Dirk Engels, Heule (BE)

(73) Assignee: Hannecard NV, Ronse (BE)

( * ) Notice: Subject to any disclaimer, the term of this patent is extended or adjusted under 35 U.S.C. 154(b) by 919 days.

(21) Appl. No.: 11/663,788

(22) PCT Filed: Sep. 23, 2005

(86) PCT No.: PCT/EP2005/010302

§ 371 (c)(1),
(2), (4) Date: Apr. 7, 2008

(87) PCT Pub. No.: WO2006/032514

PCT Pub. Date: Mar. 30, 2006

(65) Prior Publication Data

US 2009/0018004 A1 Jan. 15, 2009

(30) Foreign Application Priority Data

Sep. 24, 2004 (EP) ..... 04447210

(51) Int. Cl.
*F16D 1/09* (2006.01)
*F16D 1/092* (2006.01)
*F16D 1/093* (2006.01)

(52) U.S. Cl. ..... 492/21; 492/49; 492/22

(58) Field of Classification Search ..... 492/21, 492/38, 47, 16, 20, 48, 27, 56; 29/895.2, 29/895.22, 898.07, 895; 241/74, 117, 29; 164/108; *F16C 1/14, 13/00; B65H 59/28, 59/00, 75/24*

See application file for complete search history.

(56) References Cited

U.S. PATENT DOCUMENTS

| | | | | | |
|---|---|---|---|---|---|
| 537,789 | A | * | 4/1895 | Sinclair | 242/573.2 |
| 763,251 | A | * | 6/1904 | Breck | 492/21 |
| 1,110,804 | A | * | 9/1914 | Little | 451/504 |
| 1,708,603 | A | * | 4/1929 | Brown | 451/504 |
| 2,749,133 | A | * | 6/1956 | Rich | 279/2.12 |
| 3,997,176 | A | * | 12/1976 | Wyckoff et al. | 279/2.15 |
| 4,113,198 | A | * | 9/1978 | Rodach | 242/573.8 |
| 4,124,258 | A | * | 11/1978 | Hafner | 384/541 |
| 4,139,317 | A | * | 2/1979 | Hafner | 403/352 |

(Continued)

FOREIGN PATENT DOCUMENTS

DE 196 49 324 6/1998

(Continued)

OTHER PUBLICATIONS

International Search Report dated Jan. 19, 2006.

*Primary Examiner* — David Bryant
*Assistant Examiner* — Jason L Vaughan
(74) *Attorney, Agent, or Firm* — Knobbe, Martens, Olson & Bear LLP

(57) ABSTRACT

A roller assembly for a production machine having an inner wheel base capable of attachment to the driving axle of a production machine and an expandable outer ring which is cooperatively connectable to the inner wheel base is disclosed. The circumference of the expandable outer ring is adjustable. An outer roller cover mounts circumferentially around the adjustable expandable outer ring.

16 Claims, 9 Drawing Sheets

U.S. PATENT DOCUMENTS

| | | | | | |
|---|---|---|---|---|---|
| 4,149,682 | A | * | 4/1979 | Gustafson et al. | 242/571.3 |
| 4,229,059 | A | * | 10/1980 | Dever | 384/541 |
| 4,545,425 | A | * | 10/1985 | Johansson | 165/89 |
| 4,694,559 | A | * | 9/1987 | Lundy et al. | 29/559 |
| 5,098,523 | A | * | 3/1992 | Ilmarinen et al. | 162/358.3 |
| 5,151,737 | A | * | 9/1992 | Johnson et al. | 399/117 |
| 5,522,785 | A | * | 6/1996 | Kedl et al. | 492/21 |
| 5,820,069 | A | * | 10/1998 | Segura Salvador et al. | 242/571.3 |
| 5,996,929 | A | * | 12/1999 | Mazodier et al. | 242/573.7 |
| 6,196,494 | B1 | * | 3/2001 | Rollins et al. | 242/571.2 |
| 6,546,867 | B1 | * | 4/2003 | Franklin et al. | 101/378 |
| 7,448,484 | B2 | * | 11/2008 | Brinkmeier et al. | 193/37 |

FOREIGN PATENT DOCUMENTS

| | | |
|---|---|---|
| EP | 0 527 293 | 2/1993 |
| GB | 684234 | 12/1952 |
| GB | 2 081 420 | 2/1982 |

* cited by examiner

ROLLER ASSEMBLY WITH AN ECCENTRIC EXPANDABLE COVER RETAINING RING AND A METHOD OF MANUFACTURING THE ROLLER ASSEMBLY

RELATED APPLICATIONS

This application is the U.S. National Phase under 35 U.S.C. §371 of International Application PCT/EP2005/010302, filed Sep. 23, 2005, which claims priority to EP 04447210.8, filed Sep. 24, 2004.

BACKGROUND TO THE INVENTION

Covered rollers are used industrially in demanding environments where they are subjected to high loads, prolonged used, stresses and temperatures. They have a diversity of applications, for example, for processing web sheets in paper mills, processing aluminium or steel cans in canning industries, dosage and application of coatings (e.g. paint, varnish), counter pressure for a cutting wheel, to name a few. Due to their application in severe environments, rollers are usually engineered to be large and heavy. They are normally made out of steel or any other suitable metal alloy and in general covered with hard wearing material, such as an elastomer, for example, rubber or a polyurethane material. The covering has a specific function and goal, for example, to protect the roller core. Due to corrosion, temperature differences and other wear-related factor, the outer surface of a roller has a shorter life-span than the average life-span of the complete roller itself. This brings about the necessity of recovering the roller with a new cover, or repair of the covering, for example, by re-grinding the surface. In general, the procedure to re-cover a roller consists of several time consuming steps. The roller is dismantled at the site of use and transported to the premises of a re-coverer. After re-covering, the roller is again transported to the customer and re-installed on a production line. The customer will generally grind the rollers himself in between the different re-covering steps, in view of attuning the covered surface correctly. The procedure for repair also requires the roller to be dismantled from the site of use and transported to a grinding installation usually at the site of use.

The large size and weight of rollers necessitates removal and installation under good Health and Safety practices. This may require the use of lifting machinery, the several employees and hours of lost machine time while a spare roller is installed. The risk assessment associated with such a procedure may also have implications for insurance.

Furthermore, due to the weight and size of the rollers, the cost of transportation is high. The time taken between removing the roller and the return of the re-covered roller (lead time) is high—often several weeks (easily 4 to 6 weeks). Therefore, in order to keep the process running, the operator has to invest in a stock of spare rollers.

The rollers and procedures of the prior art are clearly associated with problems. Roller systems of the art are described in U.S. Pat. No. 6,125,753, U.S. Pat. No. 10,697,805, U.S. Pat. No. 5,601,920.

The present invention aims to overcome the problems of the prior art.

SUMMARY OF SOME EMBODIMENTS OF THE INVENTION

One embodiment of the present invention is a roller assembly for a production machine comprising:

an inner wheel base capable of attachment to the driving axle of a production machine, an expandable outer ring which co-operatively connectable to said inner wheel base, whereby the circumference of said expandable outer ring is adjustable, and a outer roller cover which is capable of mounting circumferentially around the adjustable expandable outer ring.

Another embodiment of the present invention is a roller assembly for a production machine comprising:

an inner wheel base capable of attachment to the driving axle of a production machine, an expandable outer ring with a cylindrical outer surface and an inner rim, which ring is co-operatively connectable to said inner wheel base, whereby the circumference of said expandable outer ring is adjustable, wherein said outer ring is configured to mount an outer roller cover circumferentially around the cylindrical outer surface, wherein the expandable outer ring comprises one or more expansion slits, and wherein the outer surface of the expandable outer ring is eccentric with inner rim of the expandable outer ring, such that said outer surface is concentric with the driving axle when said expandable outer ring is adjusted to secure the outer roller cover.

Another embodiment of the present invention is a roller assembly as described above, further comprising said roller cover.

Another embodiment of the present invention is a roller assembly as described above, wherein said expandable outer ring is formed from a single element.

Another embodiment of the present invention is a roller assembly as described above wherein the adjustment of the circumference of the expandable outer ring is dependent on the axial position of the expandable outer ring relative to the inner wheel base.

Another embodiment of the present invention is a roller assembly as described above wherein an outer surface of the inner wheel base adopts a conical shape.

Another embodiment of the present invention is a roller assembly as described above wherein the expandable outer ring has an inner surface which surface is complementary to an outer surface of the inner wheel base.

Another embodiment of the present invention is a roller assembly as described above wherein the expandable outer ring is disposed with one or more holes each suitable for accommodating the shaft of a bolt and the inner wheel base is provided with one or more corresponding threaded holes suitable for engaging said bolt.

Another embodiment of the present invention is a roller assembly as described above wherein:

the expandable outer ring is disposed with one or more holes each suitable for accommodating the shaft of a bolt at least partially threaded, while not engaging the thread, the wheel base is provided with one or more threaded holes suitable for engaging the thread of said bolt, at least one hole is disposed with a bolt which tightening draws the expandable outer ring towards the inner wheel base causing expansion of the expandable outer ring, and which loosening releases the expandable outer ring from the inner wheel base, causing contraction of the expandable outer ring, at least one hole is disposed with a bolt which when tightening draws the expandable outer ring towards the inner wheel base, without causing significant expansion of outer ring to engage the roller cover.

Another embodiment of the present invention is a roller assembly as described above further comprising one or more springs axially aligned between the expandable outer ring and inner wheel base.

Another embodiment of the present invention is a roller assembly as described above wherein:

the expandable outer ring is disposed with one or more holes each suitable for accommodating the shaft of a bolt at least partially threaded, while not engaging the thread, at least one hole is disposed with a bolt at least partially threaded, said bolt comprising an arrangement of a bolt-head and a ring element secured to the shaft of said bolt, the arrangement attaching the bolt to expandable outer ring while permitting free of rotation of the bolt in the hole without engaging the thread, the wheel base is provided with one or more threaded holes suitable for engaging the thread of said bolt.

Another embodiment of the present invention is a roller assembly as described above, whereby the expandable outer ring comprises one or more expansion joints.

Another embodiment of the present invention is a roller assembly as described above whereby the expandable outer ring comprises a rim determining the axial position of the roller cover.

Another embodiment of the present invention is a roller assembly as described above wherein the expandable outer ring further comprises one or more protrusions capable of acting as locating guides for the roller cover.

Another embodiment of the present invention is a roller assembly as described above wherein the roller cover comprises at least two bonded layers wherein:

an inner layer is made from a low- or non-elastic material, and an outer layer is suited to the function of the roller.

Another embodiment of the present invention is a roller assembly as described above wherein the low or non-elastic material comprises reinforced glass fibre.

Another embodiment of the present invention is a roller assembly as described above wherein the outer layer comprises one or more elastomers.

Another embodiment of the present invention is a roller assembly as described above, wherein said elastomers are any of polyurethanes, rubbers, polyisoprene, polybutadiene, or polyisobutylene.

Another embodiment of the present invention is a roller assembly as described above, the roller cover further comprises one or more apertures which act as locating guides for mounting on the expandable outer ring.

Another embodiment of the present invention is a roller cover comprising at least two bonded layers wherein:

an inner layer is made from a low- or non-elastic material, and an outer layer is suited to the function of the roller.

Another embodiment of the present invention is a roller cover further comprising one or more of the features as described above.

Another embodiment of the present invention is a roller cover as described above wherein the ratio $L/D<7$.

Another embodiment of the present invention is a roller cover as described above wherein the ratio of the diameter D, to the axial length, L i.e. D/L is a value between 1 and 12.

Another embodiment of the present invention is a method of manufacturing at least two roller covers as described above comprising the steps of:

bonding said outer layer to said inner layer to form a sleeve of roller cover, cutting said sleeve into at least two transverse sections so forming at least two roller covers.

Another embodiment of the present invention is a method for changing a roller comprising the steps of:

a) installing a roller assembly as described above, b) when the roller surface is worn, contracting the circumference of said the expandable outer ring, c) removing the roller cover, d) inserting a new roller cover, and e) expanding the circumference of said the expandable outer ring.

Another embodiment of the present invention is an inner wheel base as described above.

Another embodiment of the present invention is an expandable outer ring as described above.

Another embodiment of the present invention is a method of manufacturing a roller assembly as described above comprising the steps of mounting the expandable outer ring on the inner wheel base such that the outer roller cover, if present, would be secured, rotating the driving axle, machining the expandable outer ring to bring the outer surface into concentric alignment with the driving axle.

SUMMARY OF THE FIGURES

FIGS. 2*a* and 2*d* show a roller cover.

FIGS. 2*b* and 2*e* show an expandable outer ring.

FIGS. 2*c* and 2*f* show an inner wheel base.

DETAILED DESCRIPTION OF THE INVENTION

Figure 1A:
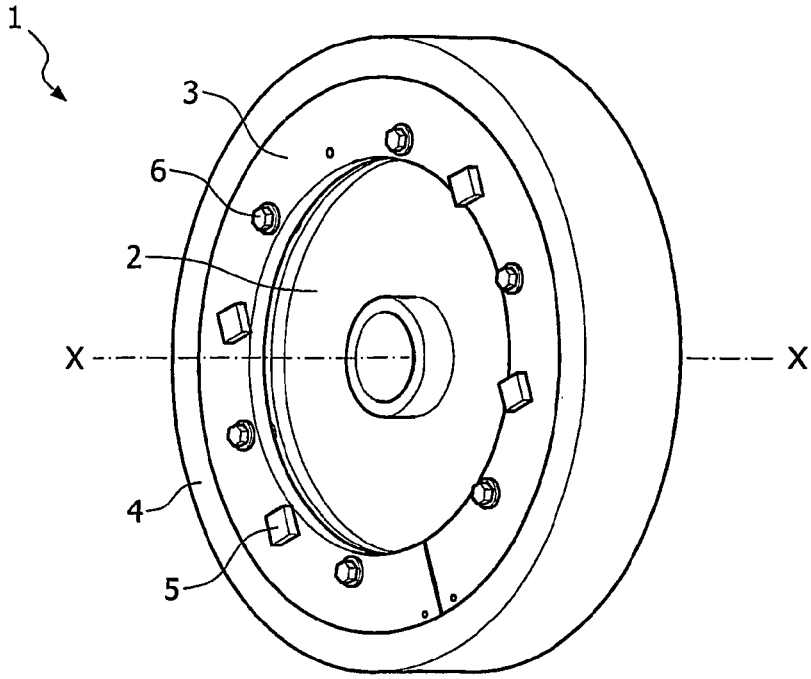
FIG. 1*a* depicts an embodiment of an assembly according to the present invention.

Unless defined otherwise, all technical and scientific terms used herein have the same meaning as is commonly understood by one of skill in the art. The articles "a" and "an" are used herein to refer to one or to more than one, i.e. to at least one of the grammatical object of the article. By way of example, "a bolt" means one bolt or more than one bolt.

Throughout this application, the term "about" is used to indicate that a value includes the standard deviation of error for the device or method being employed to determine the value.

The recitation of numerical ranges by endpoints includes all integer numbers and, where appropriate, fractions subsumed within that range (e.g. 1 to 5 can include 1, 2, 3, 4 when referring to, for example, a number of bolts, and can also include 1.5, 2, 2.75 and 3.80, when referring to, for example, length to distance ratios).

Reference is made in the description below to the drawings which exemplify particular embodiments of the invention; they are not at all intended to be limiting. The skilled person may adapt the roller assembly and substituent components and features according to the common practices of the person skilled in the art.

The present invention relates to a roller assembly for a production machine comprising:

an inner wheel base, an expandable outer ring wherein said outer ring is configured to mount a roller cover, the expandable outer ring being in contact with both the inner wheel base and the roller cover so as to couple the motion of the inner wheel base to the roller cover.

According to one embodiment of the invention, a roller assembly for a production machine comprising:

an inner wheel base capable of attachment to the driving axle of a production machine, an expandable outer ring which co-operatively connectable to said inner wheel base, whereby the circumference of said expandable outer ring is adjustable, wherein said outer ring is configured to mount an outer roller cover circumferentially around a cylindrical outer surface of the expandable outer ring.

The roller assembly may incorporate the outer roller cover as described above.

Inner Wheel Base

The inner base is capable of attachment to the driving axle of a production machine, and has an outer surface capable of coupling with an inner surface of the expandable outer ring.

According to as aspect of the invention, the inner wheel base comprises a circular plate and a surface disposed on the outer edge of the plate, capable of attaching to the driving axis of the production machine. Preferably, the attachment is such that the central axis (X-X in FIG. 1*a*) is aligned with the central axis of the driving axle. Once attached to the driving axle, the inner wheel base is able to rotate around its central axis, driven by the driving axle.

The inner wheel base has one or more means for attachment to the driving axle. The means may be any which allow secure attachment to and is compatible with the driving axle of the production machine. For example, the plate of the inner wheel base may be provided with a set of holes which align with a reciprocating set of holes on the transverse edge of driving axle of the production machine, so allowing pins, threaded bolts, or any other type of suitable attaching means to secure the inner wheel base to the driving axle.

According to one embodiment of the invention, the plate of the inner wheel base is disposed with a set of holes, each suitable for receiving a bolt which is at least partially threaded for attachment of said base to the driving axle. It is an aspect of the invention that said holes do not engage the thread of the bolt.

According to one embodiment of the invention, the material forming the circular plate is at least partially disposed within the outer edge of the plate. The material forming the circular plate may, for example, may be disposed with one or more apertures (holes). Said apertures may, for example, provide lightness or economy of manufacture, and/or said apertures might couple with locating ridges on the transverse end of the driving axle. Said apertures may be such that the plate forms one or more spokes connecting the outer surface to a ring on the central axis. According to one aspect of the invention, the plate of the inner wheel base comprises a circular aperture centered around the central axis of the inner wheel base.

The outer edge of the inner wheel base is disposed with a surface formed by the outer edge of the circular plate. The axial length of the surface may be determined by the thickness of the circular plate of the inner wheel base and by the presence of an optional rim. The surface is capable of closely coupling with the expandable outer ring. The surface may be fashioned such that close coupling to said ring is facilitated. For example, it may be cylindrical, conical or spherical in appearance. It may be disposed with grooves or slots. Said shapes and features closely couple with complementary features in the expandable outer ring.

The correct alignment of the outer roller cover is important in printing applications, for example, where the printed article (e.g. aluminium can) must receive inks in a particular axial position. According to another embodiment of the invention, the inner wheel comprises an additional rim that determines the axial position of the roller cover According to one aspect of the invention, said rim is circular, protruding from the conical surface. Such rim functions to provide an edge against which an edge of the roller cover can align.

In one embodiment of the invention, the surface formed by the outer edge of the inner wheel base is conical, the largest diameter of the cone oriented towards the driving axle. Conical shape may have any shape of base, regular or irregular. For example, the base may be circular, triangular, square, pentagonal, hexagonal, or higher order of polygon.

According to one aspect of the invention, the inner wheel base is made from one or more materials capable of withstanding the stress according to the desired operation when formed together as an inner wheel base. For example, the wheel base might be formed of aluminium. Such material and methods for selecting a material according to the desired use is known to the skilled person. Examples of such materials include, but are not limited to aluminium, cast iron, titanium, steel, and polymeric resin.

One embodiment of the present invention is an inner wheel base as described herein.

Expandable Outer Ring

The expandable outer ring is capable of attachment to the inner wheel base, and has an inner surface capable of coupling with an outer surface of the inner wheel base.

According to an embodiment of the invention, an expandable outer ring comprises a circular plate disposed with an essentially cylindrical surface on the outer edge of the plate. Said ring is capable of attaching to the inner wheel base such that its central axis (X-X in FIG. 1) is aligned with the central axis of the inner wheel base. Once attached to the inner wheel base, the expandable outer ring is able to be driven about its central axis by the driving axle and/or inner wheel base.

According to one embodiment of the invention, the expandable outer ring has one or more means for attachment to the inner wheel base. The means may be any which allow secure attachment to the inner wheel base. For example, the plate of the expandable outer ring may be provided with a set of holes which align with a complementary set of holes in the inner wheel base, so allowing pins, threaded bolts, or any other type of suitable attaching means to secure the expandable outer ring to the inner wheel base.

According to an aspect of the invention, the expandable outer ring is disposed with one or more holes each suitable for accommodating the shaft of a bolt and the inner wheel base is provided with one or more corresponding threaded holes suitable for engaging said bolt.

According to an embodiment of the invention, the expandable outer ring is disposed with a set of holes in its plate, each suitable for receiving a bolt which is at least partially threaded for attachment of said ring to the inner wheel base. It is an aspect of the invention that such holes on the expandable outer ring do not engage the thread of the bolt. According to this embodiment, the inner wheel base comprises at least one threaded hole suitable for engaging the thread of said bolt.

According to an embodiment of the invention, a bolt which connects the expandable outer wheel to the inner wheel base comprises a portion oriented towards the head of the bolt, said portion being unable to enter a threaded hole in the inner wheel base. Means to prevent entry include a larger diameter of shaft portion, a portion of non-threaded shaft, a limited depth of receiving thread in the inner wheel base, and any other means known in the art. The axial length of the non-threaded shaft defines the minimum distance attainable between the plate of the expandable outer ring and the plate of the inner wheel base. Such a bolts prevents the expandable outer ring from being over-tightened onto the inner wheel base According to one embodiment of the invention, the material forming the plate of said expandable outer ring is at least partially disposed within the outer edge of the expandable outer ring. The material forming the plate may, for example, be disposed with one or more apertures (holes), Said apertures may, for example, provide a lightweight part, or for economy of manufacture. Said apertures may be such that the plate forms one or more spokes connecting the outer surface to a ring on the central axis. In addition or alternatively, said apertures might couple with locating ridges on the plate of the inner wheel base and/or on the transverse edge of the driving axis. According to one aspect of the invention, the circular plate of the expandable outer ring comprises a circular aperture centered around the central axis of said ring.

The cylindrical surface disposed on outer edge of the expandable outer ring is formed from the edge of the plate and optionally one or more rims. The axial length of the cylindrical surface is determined by the thickness of the plate of the expandable outer ring and by the rim. This surface is capable of co-operatively contacting the roller cover.

According to another embodiment of the invention, the expandable outer ring comprises an additional rim determining the axial position of the roller cover According to one aspect of the invention, said rim is essentially perpendicular to the cylindrical surface. Such rims function, for example, to provide an edge against which an edge of the roller cover can align.

According to one aspect of the invention, the expandable outer ring is made from one or more materials capable of withstanding the stress according to the desired operation when formed together as an expandable outer ring. The expandable outer may be formed of a material which is capable of flexion under a certain and directed pressure, and capable of return to its original form when the pressure is released. For example, the expandable outer ring might be formed of cast iron. Such material and methods for selecting a material according to the desired use is known to the skilled person. Examples of such materials include, but are not limited to aluminium, cast iron, titanium, steel, and polymeric resin.

Expansion Joint(s)

The expandable outer ring is capable of increasing or reducing its circumference according to the desire of the operator, to enable the roller cover to be removed (reduced circumference) or stretched (increased circumference) over the said ring.

According to an aspect of the invention, the expandable outer ring comprises one or more expansion joints. Said joints may be any which permit the circumference of the expandable outer ring to be adjusted.

Preferably an expandable outer ring is disposed with one or more expansion slits at least partially crossing the plate and cylindrical surface. Preferably one slit ('continuous slit') cuts axially across the cylindrical surface, the slit opening as the expandable outer ring expands radially. The use of a slit to accommodate expansion, as opposed to, for example, hinged or joined multi-element hub has the advantage of a 'single entity' expandable outer ring that is stronger, harder wearing and simpler to manufacture. With regard to manufacture, the expandable outer ring may be formed, for example, from a single cast, which also brings benefits of strength. Where a plurality of slits is present, they are preferably configured also to retain the single entity i.e. they do not cut entirely across the ring which would otherwise produce a multi-element ring.

According to one embodiment of the invention, the expandable outer ring comprises an expansion joint that is a single (continuous) slit connecting the central axis of the plate to the edges of the cylindrical surface disposed on the outer circumference. Said slit runs though the full depth of the plate and cylindrical surface.

The slit crosses both outside edges of the cylindrical surface disposed on the circumference, and where the slit touches the outer edge of the plate, said slit also connects said outer edge to the inner edge (or center) of the plate.

In one embodiment of the invention said slit runs in an essentially radial direction from the center of the plate to the rim, and where said slit meets said rim, said slit crosses the cylindrical surface in a direction essentially perpendicular to the edge of the rim.

The slit may be a straight line, or may be adopt a regular or irregular shape. The slit is such that an application of a force opens said slit; the opening or closing of the slit has the effect of expanding or reducing the circumference of the outer ring. Optionally, a retraction spring may be placed across the continuous slit to ensure the closure of the slit upon release from the inner wheel hub. The retraction spring may be placed within a groove crossing the slit such that the spring means does not contact the outer roller cover.

According to another aspect of the invention, expansion joint is a partial slit that cuts either inside edge of the plate (plate opening (PO) partial slit) or the edge of the cylindrical surface disposed on the outer circumference (cylindrical surface opening (CSO) partial slit), but not both. Because the partial slits do not cut entirely across the expandable outer ring, the partial slit retains the expandable outer ring as a single element. Said partial slit run though the full depth of the plate and cylindrical surface.

A partial slit preferably runs along the line connecting the central axis of the plate to the edges of the cylindrical surface disposed on the outer circumference. The partial slit preferably runs in an essentially radial direction from the center of the plate to the rim, and where said partial slit meets said rim, said slit crosses the cylindrical surface in a direction essentially perpendicular to the edge of the rim. The partial slit may be a straight line, or may be adopt a regular or irregular shape. The partial slit is of such length such that an application of a force opens or closes said slit; the opening or closing of the slit has the effect of expanding or reducing the circumference of the outer ring.

Where a plurality of expansion joints is present, a preferred configuration comprises two or more (e.g. 3, 4, 5, 6, 7, 8, 9, 10) partial slits in which the number of PO partial slits is no more than one greater or one less than the number of CSO partial slits. Preferably the PO and CSO partial slits are disposed evenly around the surface of the cylinder. Preferably the majority of the PO and CSO partial slits are disposed alternately around the surface of the cylinder. It is an aspect of the invention that an expandable outer ring comprises two or more (e.g. 3, 4, 5, 6, 7, 8, 9, 10) partial slits and one continuous slit.

According to one aspect of the invention, an expansion joint is opened and closed by any mechanism known in the art. For example, a threaded rod may be secured across the opening. Turning the rod in one direction would open the joint, so expanding the outer ring, and tightening the roller cover. Turning the rod in the other direction would close the joint, so reducing the circumference of the outer ring, and loosening the roller cover.

Concentric Aspect

A feature of the present invention is that the roller cover is concentric with the driving axle of the production machine. This is important in applications such as printing, where inks are evenly distributed over a roller, and the printed article able to pass thereover in a smooth manner. In the prior art, the adjustment to the expandable outer ring is linked to the driving axle, said axle co-operatively coupled to adjustable elements. This arrangement provides concentricity, but to the cost of elements that must span the radius of the roller. To achieve an adjustable system, therefore, substantially larger and heavier elements are required, together with an adjustment mechanism coupled to the driving axle.

The present invention achieves a roller that is truly concentric with the driving axle, without the requirement to couple with the driving axis. According to one aspect of the invention, the outer surface of the expandable outer ring is eccentric with inner rim of the expandable outer ring, such that said outer surface is concentric with the driving axle when said expandable outer ring is adjusted to secure the outer roller cover.

To achieve a suitably eccentric expandable outer ring, said ring is mounted on the inner wheel base, the driving axle is rotated, and the expandable outer ring machined in situ to bring the outer surface into concentric alignment with the driving axle. By machining the expandable outer ring in a tightened position and removing the eccentric part of the surface, the concentricity of the ring is restored. At the same time, the outer surface of the ring becomes eccentric with respect to the inner rim. The tightened position is such that the expandable outer ring, after machining, is still capable of securing the outer roller cover. The tightened position is such that the expandable outer ring, after machining, is within ±0.01, ±0.02, ±0.03, ±0.04, ±0.05, ±0.06, ±0.07, ±0.08, ±0.09, ±0.1, ±0.11, ±0.12, ±0.13, ±0.14, ±0.15 mm of the desired diameter suitable for securing the outer roller cover.

Conical Shaped

According to another aspect of the invention, the expansion joint is expanded or contracted by the coupling of the expandable outer ring to a conical-shaped inner wheel base.

According to this aspect of the invention, a conical shaped inner wheel base co-operatively connects with the inside surface of the expandable outer ring.

According to one aspect of the invention, a conical shaped inner wheel base co-operatively connects with the inner rim of the expandable outer ring. The inner rim being the surface of the rim facing the central axis of the expandable outer ring. The inner rim faces the inner wheel base when mounted on the production machine. As the expandable outer ring is tightened onto the production machine, the conical shaped inner wheel base, being of widest diameter towards the driving axle side, forces the slit open due to pressure on the inner rim. The more the expandable outer ring is tightened onto the production machine, for example, by way of threaded bolts, the greater the circumference of the expandable outer ring.

According to one aspect of the invention, the inner rim of the expandable outer ring is formed such that it is complementary to the shape of the surface disposed on the outside edge of the inner wheel base. Where the inner wheel base is conical, the expandable outer ring may adopt a complementary conical shape by way of a suitably formed inner rim. The shape is such that the cone-shaped inner wheel base couples to the cone-shaped surface of the inner rim of the expandable outer wheel, with sufficient clearance between the plates of the respective wheels to allow the tightening to be accompanied a narrowing of said clearance and opening of the slit. Thus, the adjustment of the circumference of the expandable outer ring is dependent on the axial position of the expandable outer ring relative to the inner wheel base.

Bolts

According to one aspect of the invention, bolts which are at least partially threaded are used to attach the expandable outer ring to the inner base wheel or drive axle. Such bolts are positions in holes in the plate of the outer ring, said holes not engaging the thread of the bolt. They engage in threaded holes positioned in the inner wheel base or in the drive axle.

It is an aspect of the invention that one or more of said bolts is used to adjust the axial position of the outer ring relative to the inner wheel base. A tightening of said bolt engages the outer ring more closely with the inner wheel base via pressure applied through the bolt head. Unscrewing the bolt moves the outer ring away from the inner wheel base. The mechanism by which turning the bolt is coupled to the axial movement of the outer ring can be any. Two such mechanisms are described below, though the invention should not be limited thereto.

Sprung Release

According to one embodiment of the invention, one or more springs are axially aligned between the outer ring and inner wheel base. Preferably said springs are positioned between plate of the outer ring and the plate of the inner wheel base. Said springs maintain a defined axial distance there between. Tightening a bolt compresses the springs, so reducing the axial distance. Energy in the spring is released as the bolt is unscrewed, allowing the axial movement of the outer ring away from the inner wheel base. This enables easy release of the expandable outer ring from the assembly. Furthermore, such arrangement allows the operator to select the distance of the expandable outer ring from the inner wheel base. Where the inner base wheel has a conical surface disposed on the circumference, and the expandable outer ring has a slit, such a bolt may be tightened to expand the slit. Upon loosening the bolt, the spring forces the said outer ring away from the inner wheel base, and said ring contracts.

The springs may be disposed in suitable grooves present in the respective plates. Preferably a spring is disposed around the shaft of a bolt.

It is an aspect of the invention that a) adjusting bolts as described above are used to secure the expandable outer ring to the inner wheel base and/or driving axle, and b) stop bolts, are used prevent the expandable outer ring from completely disengaging the inner wheel base when loosened. Such stop bolts are positioned in holes in the plate of the outer ring, said holes not engaging the thread of the bolt. They engage in threaded holes positioned in the inner wheel base or in the drive axle. Once tightened, the head of stop bolt draws the expandable outer ring towards the inner wheel base, without causing significant expansion of outer ring to engage the roller cover. Once tightened, the stop bolts are usually not removed except, for example, to service the outer expandable ring. It is an aspect of the invention that bolts of type a) and type b) have different shaped heads. For example, bolts of type a) may have a hexagonal shaped head, while the bolts of type b) may have a square shaped head. Such distinction enables the operator to readily recognise the function of each bolt.

Theaded Release

According to another embodiment of one or more bolts comprises a means to attach the bolt to the expandable outer ring while allowing the bolt to rotate freely. Such means may be provided by, for example, a ring element (e.g. a secured ring element or secured washer) located on the shaft of the bolt; the plate of the expandable outer ring is held between the head of the bolt and the ring element. Such an arrangement secures the expandable outer ring between the bolt head and the ring element. The ring element may be secured by any means, such as for example, a cotter pin threaded through a suitably placed hole in the bolt, by means of a fixing screw located in the side of the ring element. Preferably the ring element is located close to the plate of the expandable ring while still permitting freedom of rotation of the bolt in the hole of the expandable outer ring. According to one embodiment of the invention, the gap between the plate and the ring element is less than 1 mm, 2 mm, 3 mm, 4 mm, 5 mm, 6 mm, 7 mm, 8 mm, 9 mm, or 10 mm.

Such an arrangement may be used to force the expandable outer ring from the inner wheel base upon unscrewing of the bolt; the secured ring element would apply pressure onto the plate of the expandable outer ring upon releasing the bolt. This enables easy release of the expandable outer ring from the assembly. Furthermore, such arrangement allows the operator to select the distance of the expandable outer ring from the inner wheel base. Where the inner base wheel has a conical surface disposed on the circumference, and the expandable outer ring has a slit, such a bolt may be tightened to expand the slit. Upon loosening the bolt, the secured ring element engages with the plate of the expandable outer ring forcing the outer ring away from the inner wheel base, so contracting said ring.

It is an aspect of the invention that both i) bolts comprising a ring element and ii) bolts not comprising a ring element are used to secure the expandable outer ring to the inner wheel base and/or driving axle. Bolts of the type i) may be used by the operator to adjust the expandable outer ring to the correct circumference and bolts of type ii) may be used to further secure the expandable outer ring in place. It is an aspect of the invention that bolts of type i) and type ii) have different shaped heads. For example, bolts of type i) may have an hexagonal shaped head, while the bolts of type ii) may have a square shaped head. Such distinction enables the operator to readily recognise the function of each bolt.

The bolts described above enable the circumference of the expandable outer ring to be enlarged or contracted enable the roller cover to be removed, replaced and tightened while the inner wheel base and expandable outer ring remain on the production machine.

According to one embodiment of the invention, the inner wheel bases comprises one or more holes or grooves to accommodate the size of the protruding aforementioned ring element.

Patch

According to another aspect of the invention the cylindrical surface of the expandable outer ring further comprises one or more protrusions which act as locating guides for the roller cover. It is an aspect of the invention that said protrusions are located towards the edges of said cylindrical surface. The protrusions may be of any shape, for example, square, triangular, circular, irregular shape, which are able to locate with a complementary shaped aperture in the roller cover.

According to one aspect of the invention, said protrusion may be between 0.5 to 1 mm, 0.6, 0.7, 0.8, or 0.9 mm thick, and 1, 2, 3, 4 or 5 mm wide.

Ratio

According to an aspect of the invention, the essentially cylindrical surface of the expandable outer ring has a dimension such that the condition D/L greater than or equal to 12, 11, 10, 9, 8, 6, 5, 4, 3 or 2 or 1 is fulfilled or is a value in the range between any two of the aforementioned values, wherein L is the axial length and D is the diameter. Preferably, D/L is between 1 and 12.

One embodiment of the present invention is an expandable outer wheel as described herein.

Roller Cover

The roller cover is an essentially cylindrical-shaped sleeve which is capable of mounting the expandable outer ring. When mounted on the expandable outer ring, the internal surface of the roller cover is capable of closely cooperating with the cylindrical surface of the expandable outer ring. When said ring is in a contracted state, it is an aspect of the invention that the roller cover may be capable of freely rotating around the expandable outer ring. Such freedom of movement allows an operator to mount and dismount the roller cover from the expandable outer ring. When the outer ring is in an expanded state, it is an aspect of the invention that the roller cover may be gripped against said ring such that it does not significantly rotate around or laterally displace along the expandable outer ring during operation.

According to one aspect of the invention, the roller cover is any of the art.

According to another embodiment of the invention, the roller cover comprises at least two layers. The layers may be held by a bonding process.

An inner layer of the roller cover, which is capable of co-operatively contacting the cylindrical surface of the expandable outer ring, may be formed from a non- or low-elastic material. Such material would exhibit no or little expansion upon expansion of the outer ring. Such suitable material is known to the skilled person, or may be derived by standard and routine methods. Examples of suitable materials include but are not limited to reinforced glass fibre, carbon fibre, aluminium or aluminium alloys. Preferably, the material is reinforced glass fibre.

It is an aspect of the invention that the inner layer has a thickness of 1, 2, 3, 4, 5, 6, 7, 8, 9, or 10 mm.

An outer layer of the roller cover according to the same embodiment provides the surface on which the function is performed e.g. the application of paint, counter pressure etc. The composition of the outer layer of the roller cover, therefore, varies according to the application. Such compositions are known to the skilled practioner, taking into account the desired properties for the application, diameter and longitudinal length of the expandable outer ring.

According to one aspect of the invention, the outer layer of the covered roller comprises one or more elastomers, such as, for example, polyurethanes, rubbers, polyisoprene, polybutadiene, or polyisobutylene.

The outer and inner layers are bonded i.e. both layers are bonded together with or without the presence of other intervening layers.

According to one aspect of the invention, the outer layer comprises polyurethane (PU). According to one aspect of the invention a roller cover comprising an inner layer of reinforced glass fibre and an outer layer of PU, is prepared by applying polyurethane to the inner layer in a machined metal mould. Alternatively ribbon flow casting can be applied.

Following application of the second layer, the curing or vulcanisation of the roller cover may take place in a furnace, such as a steam furnace or autoclave.

According to one aspect of the invention, the outer layer comprises one or more rubber compounds. According to one aspect of the invention, a roller cover comprising an inner layer of reinforced glass fibre and an outer layer of rubber is prepared by wrapping calandered sheets comprising rubber compound around the glass fibre inner layer. Care is usually taken such that air does not intrude between the two layers. Following application of the second layer, the curing or vulcanisation of the roller cover may take place. In this process, the separate rubber sheets consolidate to form a homogenous mass that will bond to the glass fibre inner layer. Due care is taken such that the consolidation proceeds correctly.

According to one embodiment of the invention, the roller cover is ground after application of the outer layer to the inner layer. In one aspect of the invention, the roller cover is mounted on a lathe and finished by grinding. Said finishing produces the desired diameter and roughness (Ra).

According to one embodiment of the invention, the roller cover is prepared such that length along the longitudinal axis exceeds the longitudinal length of the cylindrical surface of the expandable ring. In such cases, the roller cover is cut to length. Optionally, several roller covers may be cut from a single length of produced sleeve, so providing an economy of scale. Where a roller cover is cut, the edges are cleaned and finished prior to use in the production machine. The number of rollers that can be prepared in one batch may be 2, 3, 4, 5, 6, 7, 8, 9, 10, or 11 or more.

Patch

According to one embodiment of the invention the roller cover comprises one or more apertures which act as locating guides for mounting on the expandable outer ring. The apertures may be of any shape, for example, square, triangular, circular, irregular shape, which are able to locate with a complementary-shaped protrusion on the expandable outer ring. According to one aspect of the invention, said aperture may be between 0.5 to 1 mm, 0.6, 0.7, 0.8, or 0.9 mm thick, and 1, 2, 3, 4 or 5 mm wide.

Ratio

According to an aspect of the invention, the roller cover has a dimension such that the condition D/L is greater than or equal to 12, 11, 10, 9, 8, 7, 6, 5, 4, 3, 2 or 1 is fulfilled, or is a value in the range between any two of the aforementioned values, wherein L is the axial length and D is the outer diameter. Preferably, D/L is between 1 and 12.

Methods

Another embodiment of the present invention is a method for changing a roller comprising the steps of:

a) installing a roller assembly onto a production machine, b) when the roller surface is worn, contracting the circumference of said the expandable outer ring, c) removing the roller cover, d) inserting a new roller cover, and e) expanding the circumference of said the expandable outer ring.

The assembly of the present invention overcomes the problems of the prior art. Once an inner base wheel and expandable ring of the invention have been installed on the driving axle of the production machine, there is no necessity to remove them during the process of replacing the roller. The operator is required only to reduce the circumference of the expandable outer ring using an operative means, in order to loosen the roller cover. Said cover may be removed and a new cover inserted during the same procedure.

Such advantageous features reduce the machine down time, due to a fast exchange of the roller cover. Furthermore, there is almost no requirement for aligning the roller, since the inner wheel base is not adjusted during change of the roller cover.

Due to the light weight of the roller cover, less machinery and personnel are required during the procedure to change the roller cover, and, furthermore, there is a less stringent requirement before Health and Safety procedures. For example, the weight of the roller cover may be 7 to 12 Kg compared with a weight of 28 to 50 Kg for a complete wheel. The reduced risk of dangerous accident necessitates a less stringent safety precaution.

The requirement for a stock of wheels to cover production during re-grinding is minimized using the present invention. Using roller of the art, an operator will need to have a stock of between 80 to 100 wheels at his disposal. The present invention allows a considerable reduction of stock; a minimum stock of 3 wheels would be necessary—1 per production unit, 1 spare and 1 for regrinding. The reduction of a requirement for spare wheels reduces the capital tied up in spare stock, and releases storage space.

Due to the light weight of the roller covers, the costs involved in transportation are reduced. There are no costs associated with transportation to a recovery company (and administration thereto) and the recyclable nature of the invention also has a positive environmental impact.

From the point of view of the recover company, who manufactures roller covers according to the invention, the light weight of the roller sleeve permits market extension. The weight of complete rollers imposes a limitation on markets due to the expense of transportation. The sleeves may be shipped in bulk and in one direction so contributing to a reduction in distribution costs, and making more distant markets accessible.

Because the roller covers can be manufactured as a long sleeve which is subsequently cut into sections, the roller covers can be manufactured in bulk. The bulk production also cuts costs.

DETAILED DESCRIPTION OF THE FIGURES

FIG. 1*a* depicts an embodiment of an assembly 1 according to the present invention, comprising an inner wheel base 2, an expandable outer ring 3, a roller cover 4, and two types of bolt 5, 6 for securing the expandable outer ring 3 to the wheel base 2. The central axis of the inner wheel base 2 and expandable outer ring 3 is indicated by the line X-X.

Figure 1B:
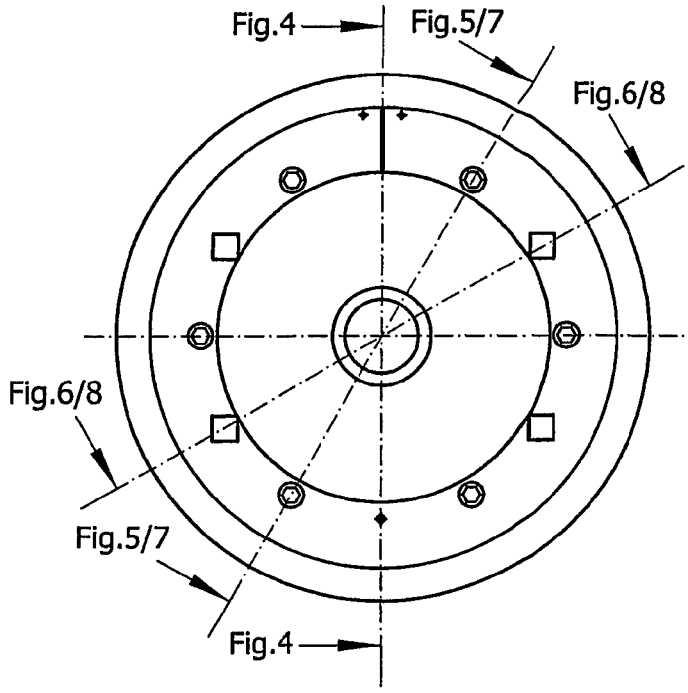
FIGS. 1*b* and 1*c* depict plan and side views of the assembly of FIG. 1*a*, and indicate the axis of the cross-sectional view of FIGS. 4, 5, 6, 7 and 8.
Figure 1C:
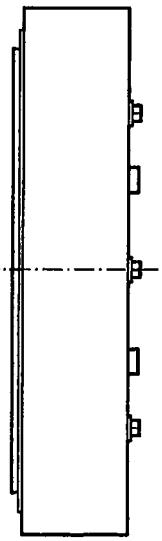

FIGS. 1*b* and 1*c* depict plan and side views of the assembly of FIG. 1*a*, and indicate the axis of the cross-sectional views of FIGS. 4, 5, 6, 7 and 8.

Figure 2A:
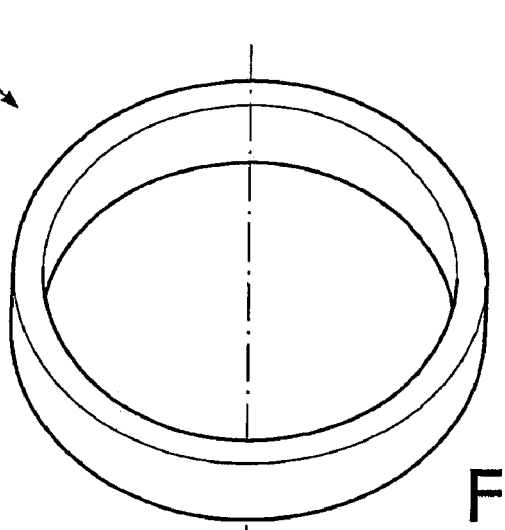
FIGS. 2*a* to 2*c* represent an exploded view of an assembly according to FIGS. 1*a* to 1*c* in which an aligning rim 215 is present on the inner wheel base.
Figure 2B:
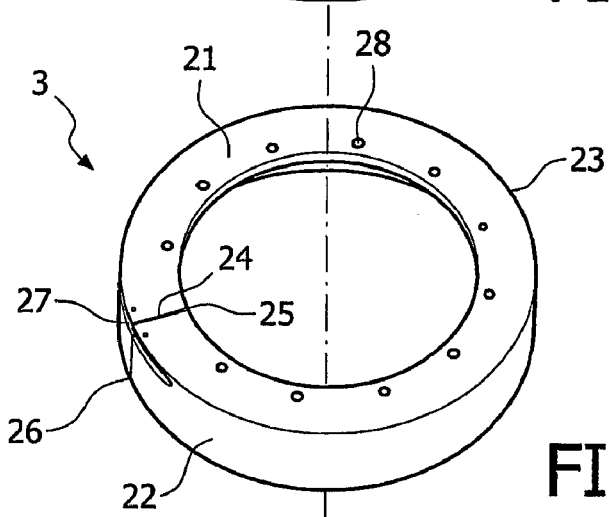
Figure 2C:
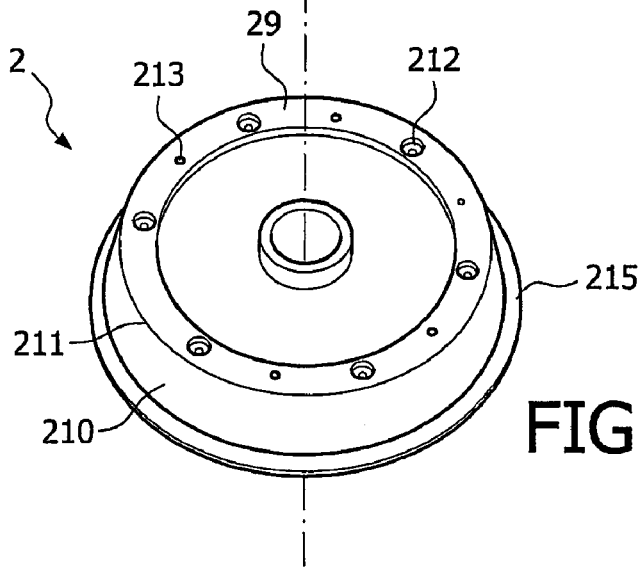

FIGS. 2*a* to 2*c* represent an exploded view of an assembly according to FIGS. 1*a* to 1*c*. FIG. 2*a* shows a roller cover 4.

FIG. 2*b* shows an expandable outer ring 3, comprising a circular plate 21, and an essentially cylindrical surface 22 disposed on the outer edge 23 of the plate. The expandable ring 3 is provided with a continuous slit 24 which connects the inside edge of the plate 25 with both edges 26, 27 of the cylindrical surface 22. The expandable ring 3 is also provided with holes 28 suitable for receiving the shaft of a bolt at least partially threaded, said holes not engaging with said thread.

FIG. 2*c* shows an inner wheel base, comprising a circular plate 29, and a surface 210 disposed on the outer edge 211 of the plate 29, said surface 210 having a conical shape. The inner wheel base 2 is also provided with holes 212, 213 suitable for receiving the shaft of a threaded bolt, said holes engaging with said thread. One set of holes (e.g. 212) further comprises a recess for accepting, for example; a ring disposed around the shaft of a bolt. The inner wheel base 2 is also provided with a rim 215 which is essentially perpendicular to the drive axle, against which an edge of the roller cover may abut.

Figure 2D:
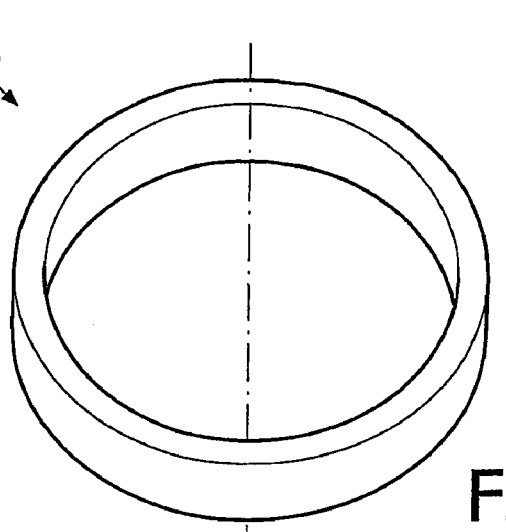
FIGS. 2*d* to 2*f* represent an exploded view of another assembly according to FIGS. 1*a* to 1*c*, in which an aligning rim 214 is present on the expandable outer ring.
Figure 2E:
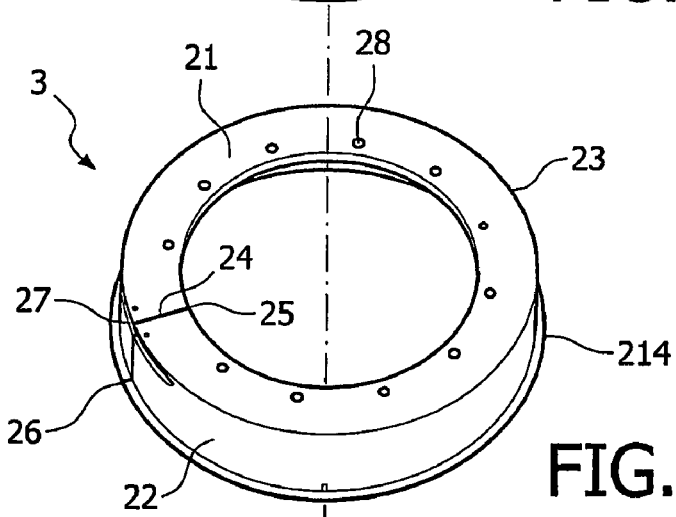
Figure 2F:
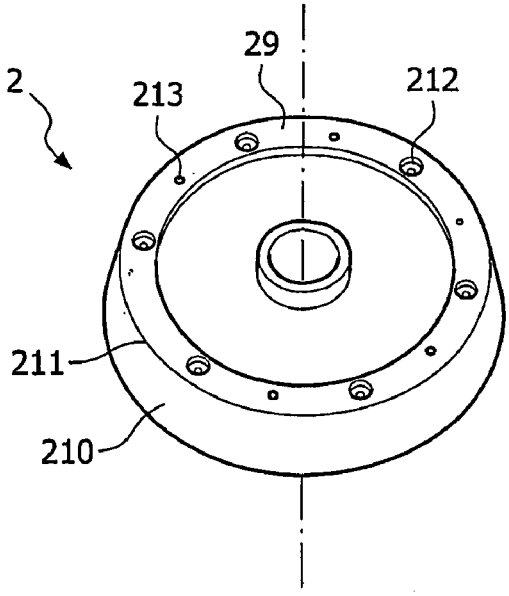

FIGS. 2*d* to 2*f* represent an exploded view of an assembly according to FIGS. 1*a* to 1*c*. FIG. 2*d* shows a roller cover 4.

FIG. 2*e* shows an expandable outer ring 3, comprising a circular plate 21, and an essentially cylindrical surface 22 disposed on the outer edge 23 of the plate. The expandable ring 3 is provided with a slit 24 which connects the inside edge of the plate 25 with both edges 26, 27 of the cylindrical surface 22. The expandable ring 3 is also provided with holes 28 suitable for receiving the shaft of a bolt at least partially threaded, said holes not engaging with said thread. The expandable ring 3 is also provided with a rim 214 which is essentially perpendicular to the cylindrical surface against which an edge of the roller cover may abut.

FIG. 2*f* shows an inner wheel base, comprising a circular plate 29, and a surface 210 disposed on the outer edge 211 of the plate 29, said surface 210 having a conical shape The inner wheel base 2 is also provided with holes 212, 213 suitable for receiving the shaft of a threaded bolt, said holes engaging with said thread. One set of holes (e.g. 212) further comprises a recess for accepting a protruding ring element attached to a bolt.

Figure 3A:
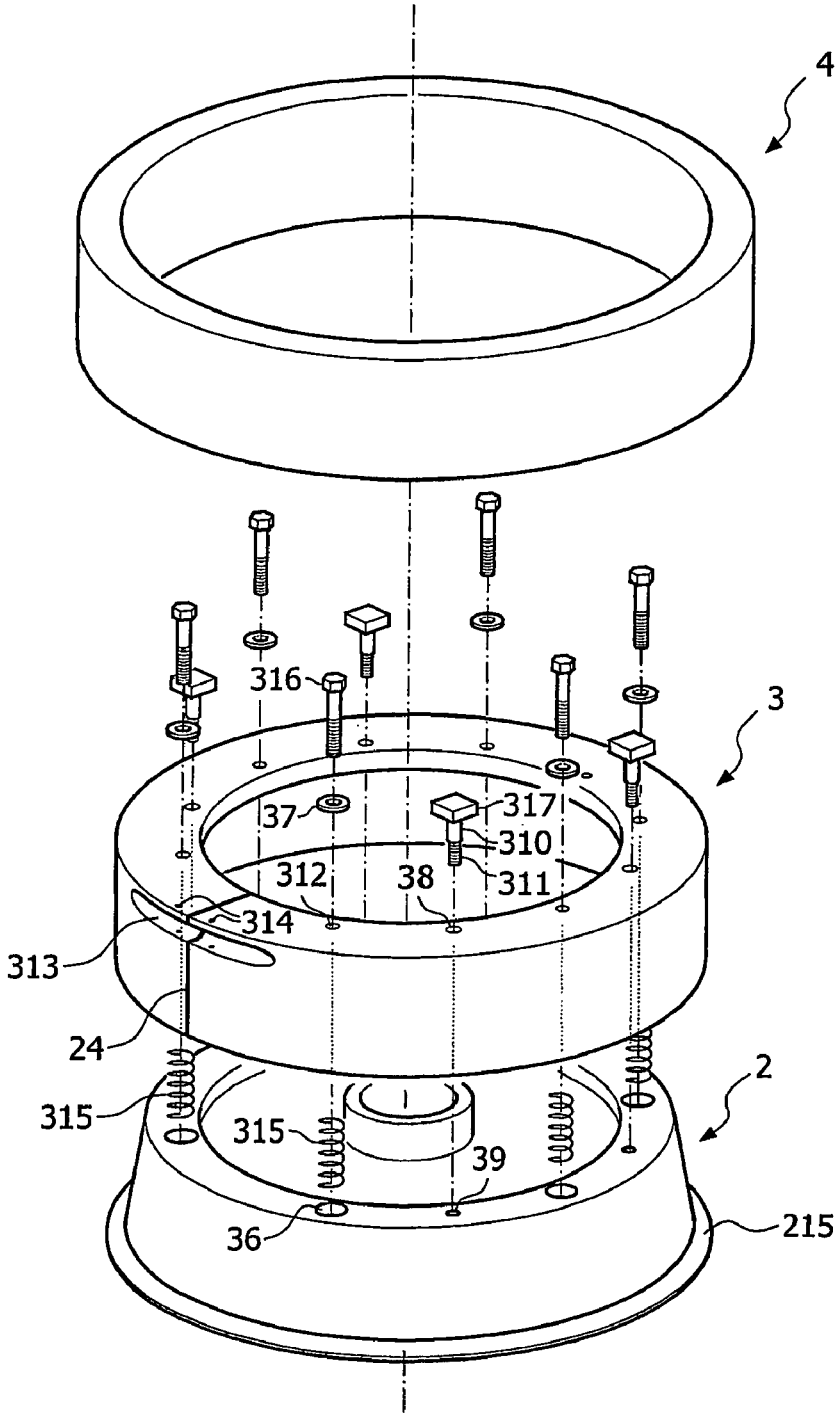
FIG. 3*a* shows an exploded view of the assembly according to FIG. 1, together with a set of sprung bolts.
Figure 3B:
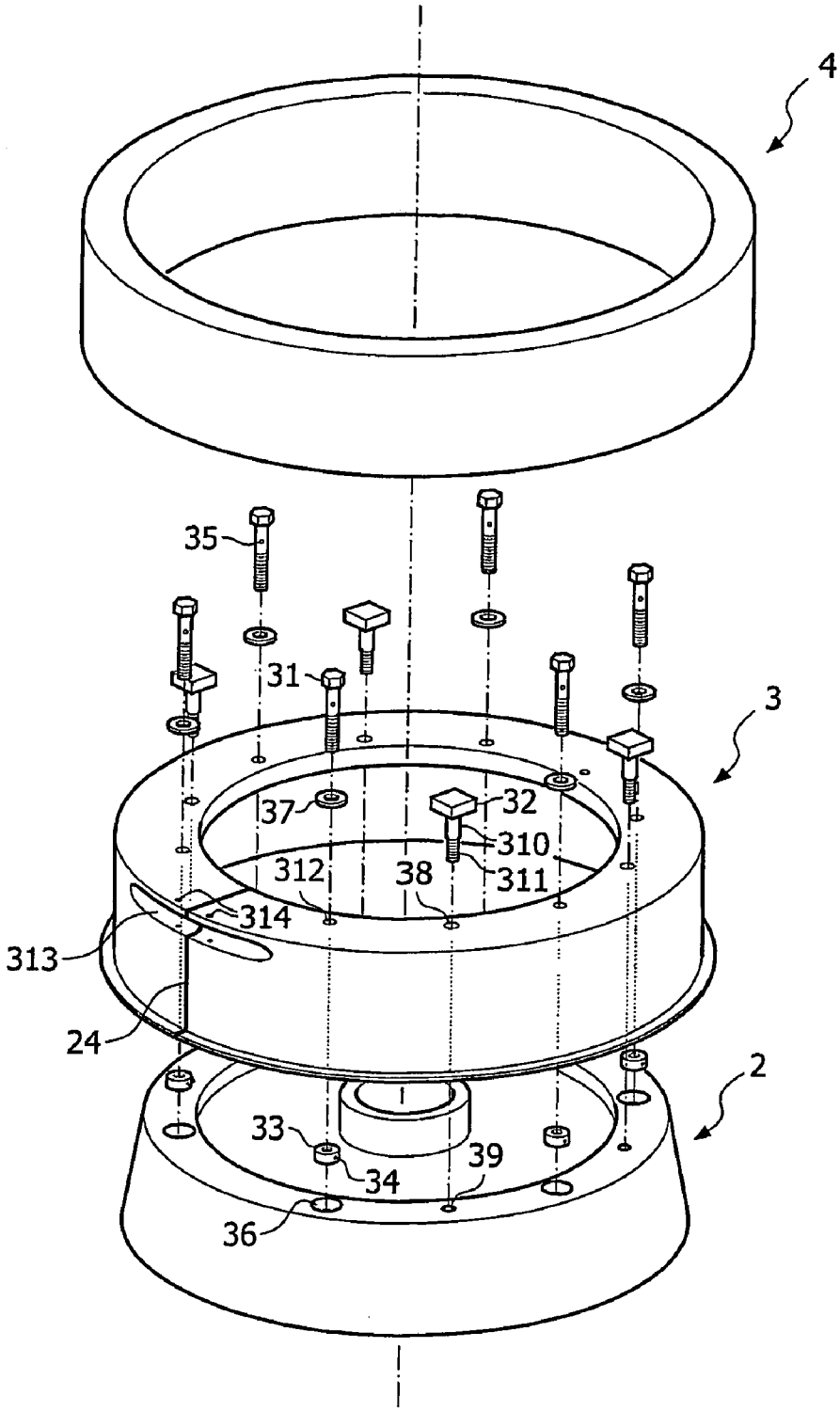
FIG. 3*b* shows an exploded view of the assembly according to FIG. 1, where the bolts are disposed with securing ring elements.

FIG. 3*a* shows an exploded view of the assembly according to FIG. 1, together with a set of bolts (e.g. 316, 317) for fixing the expandable outer ring 3 to the inner base wheel 2. The illustration depicts a bolt with an hexagonal head 316 (though any shape of head may be applied in practice) which passes through a hole 312 in the expandable outer ring. The shaft of each bolt 316 passes through a spring 315 located between the inner wheel base 2 and the expandable outer ring 3. A recess 36 in the each threaded hole of the inner wheel base 3 is able to accommodate the diameter of the spring 315 so acting as a partial support for the compressed spring. Each hexagonal-headed bolt can engage with thread located in the inner wheel base. Each hexagonal-headed bolt may also tighten onto a washer 37. The illustration also depicts a bolt with a square head 317 (though any shape of head may be applied in practice), which passes through a hole 38 in the expandable outer ring, to engage with a threaded hole 39 in the inner wheel base 2. In an embodiment of the invention, the square headed bolt comprises a partially non-threaded shaft 310 oriented towards the head of the bolt which cannot enter a threaded hole suitable for receiving the threaded part 311 of the shaft. According to an embodiment of the invention, a cavity 313 in the cylindrical surface functions to accommodate a retraction spring, physically mounted onto pins that are inserted into holes 314 either side of the slit. The function of this spring is to assure the retraction of the expandable outer ring when releasing it from the inner base wheel via unscrewing the bolts 316. This will ensure at all times easy removal of the roller cover 4 when replacing it with a new one. The inner wheel base 2 is disposed with a rim 215 against which the roller cover 4 aligns FIG. 3*b* shows an exploded view of the assembly according to FIG. 1, together with a set of bolts (e.g. 31, 32) for fixing the expandable outer ring 3 to the inner base wheel 2. The illustration depicts a bolt with an hexagonal head 31 (though any shape of head may be applied in practice) which passes through a hole 312 in the expandable outer ring. Said bolt 31 is attachable to the plate of the expandable outer ring by means of a ring element 33. In this instance, the ring element is a collar comprising a hole 34 which aligns with a hole 35 in said bolt 31. A cotter pin threaded through both holes attaches the bolt to the plate while allowing free rotation of the bolt. A recess 36 in the each threaded hole of the inner wheel base 3 is able to accommodate the size of the protruding ring element 33. Each hexagonal-headed bolt engages with a washer 37. The illustration also depicts a bolt with a square head 32 (though any shape of head may be applied in practice), which passes through a hole 38 in the expandable outer ring, to engage with a threaded hole 39 in the inner wheel base 2. In an embodiment of the invention, the square headed bolt comprises a partially non-threaded shaft 310 oriented towards the head of the bolt which cannot enter a threaded hole suitable for receiving the threaded part 311 of the shaft. According to an embodiment of the invention, a cavity 313 in the cylindrical surface functions to accommodate a retraction spring, physically mounted onto pins that are inserted into holes 314 either side of the slit. The function of this spring is to assure the retraction of the expandable outer ring when releasing it from the inner base wheel via unscrewing the bolts 31. This will ensure at all times easy removal of the roller cover 4 when replacing it with a new one.

Figure 4A:
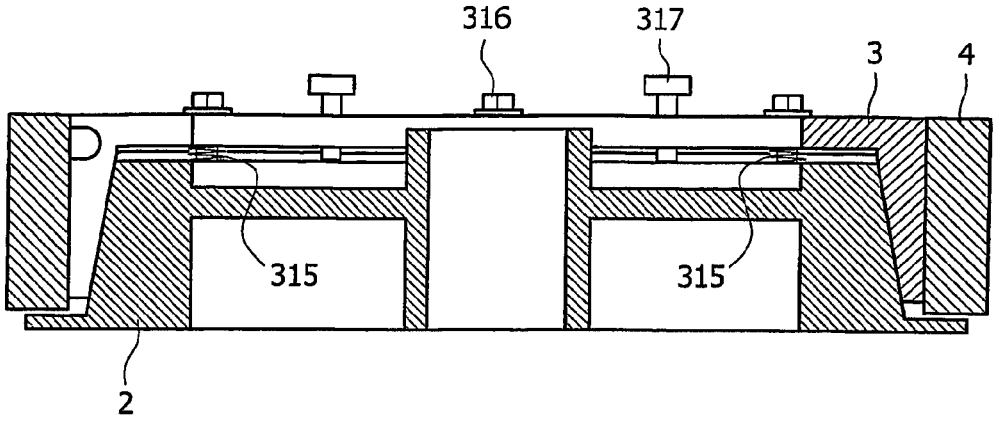
FIGS. 4*a* and 4*b* depict a transverse cross-section of an assembly as indicated in FIG. 1, in which the bolts are disposed with springs or ring elements respectively.

FIG. 4*a* depicts a transverse cross-section of an assembly as indicated in FIG. 1. Shown in cross-section is the roller cover 4, the expandable outer ring 3, the inner wheel base 2, a hexagonal headed bolt, 31 together with a spring 315, and a square headed bolt 32.

Figure 4B:
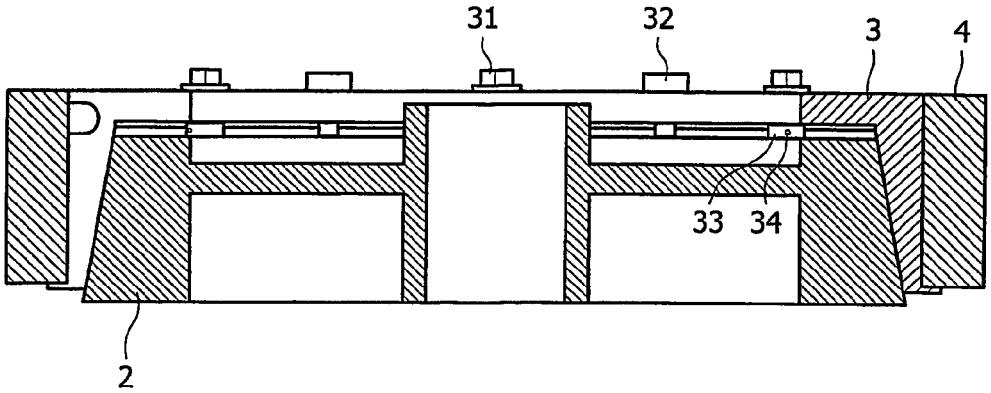

FIG. 4*b* depicts a transverse cross-section of another assembly as indicated in FIG. 1. Shown in cross-section is the roller cover 4, the expandable outer ring 3, the inner wheel base 2, a hexagonal headed bolt, 31 together with ring element 33 disposed with a hole 34 suitable for a cotter pin, and a square headed bolt 32.

Figure 5:
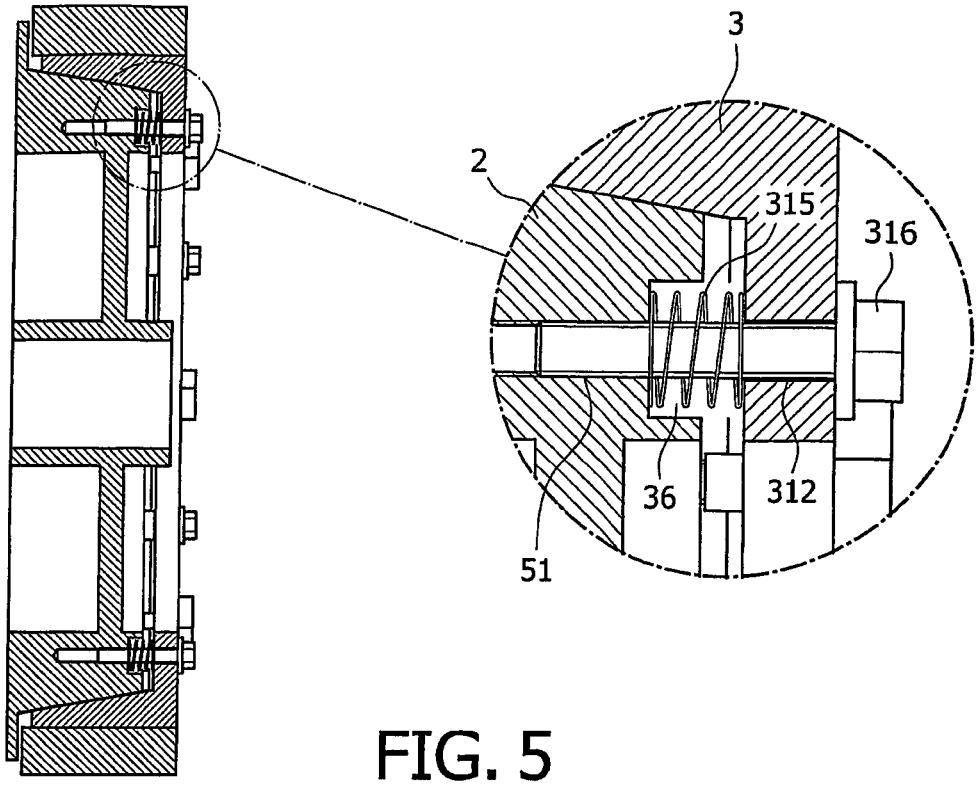
FIG. 5 is an expanded view of the transverse cross-section of the assembly as indicated in FIG. 1 with a detail of an hexagonal headed sprung bolt.

FIG. 5 is an expanded view of the transverse cross-section of the assembly as indicated in FIG. 1. Shown in the expanded view is the cross-section of the hexagonal headed bolt, 316 (though any shape of head may be applied in practice) together with a spring 315 coiled around the shaft of the bolt. Said bolt passes through a non-threaded hole 312 in the expandable outer ring 3, and the thread thereof engages with a threaded hole 51 in the inner wheel base 2. A recess 36 in the inner wheel base is present to at least partially accommodate the spring 315.

Figure 6:
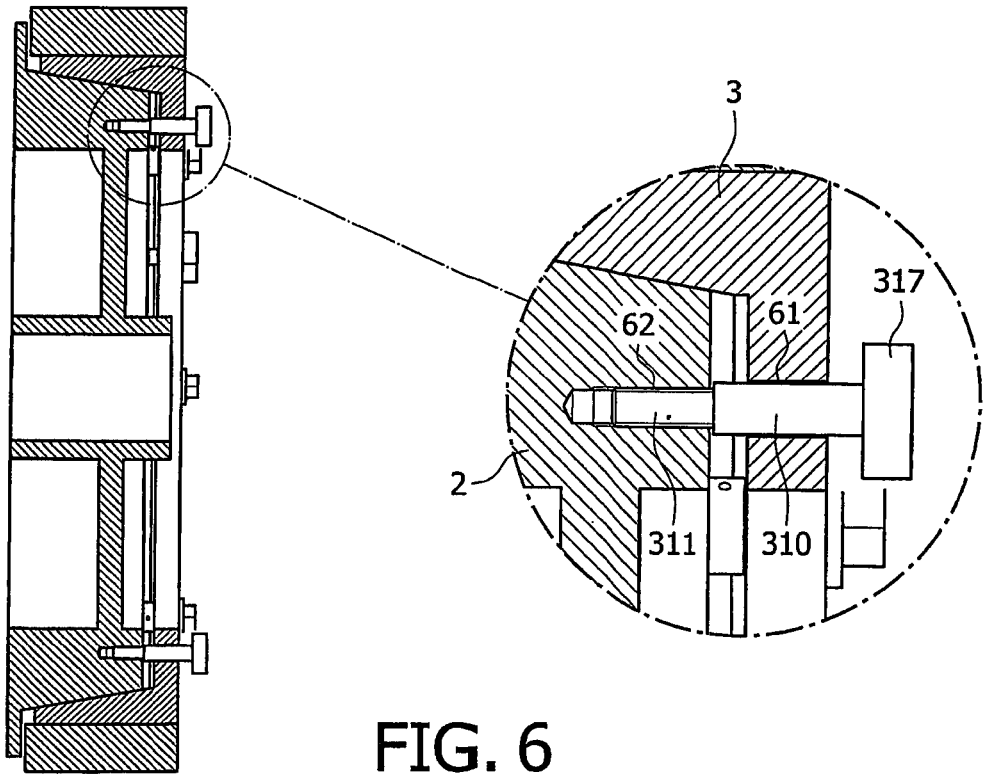
FIG. 6 is another expanded view of the transverse cross-section of the assembly as indicated in FIG. 1 with a detail of a square headed stop bolt.

FIG. 6 is another expanded view of the transverse cross-section of the assembly as indicated in FIG. 1. Shown in the expanded view is the cross-section of the square headed stop bolt, 317 (though any shape of head may be applied in practice), having a shaft which is partially threaded 311 and non-threaded 310. The shaft of the bolt passes through a hole 61 in the expandable outer ring 3, which does not engage the thread. A hole 62 in the inner wheel bases engages the thread of the bolt 311. Diameter of said hole 62 is such that the non-threaded portion of the shaft 310 cannot enter. The head of the bolt 317 prevents the outer ring 3 from completely disengaging from the wheel base 2. The head of the bolt 317 in the tightened position does not sufficiently engage the outer ring 3 to cause expansion. When the expandable outer ring expanded, the head of the bolt 317 stands proud of the plate of the expandable outer ring.

Figure 7:
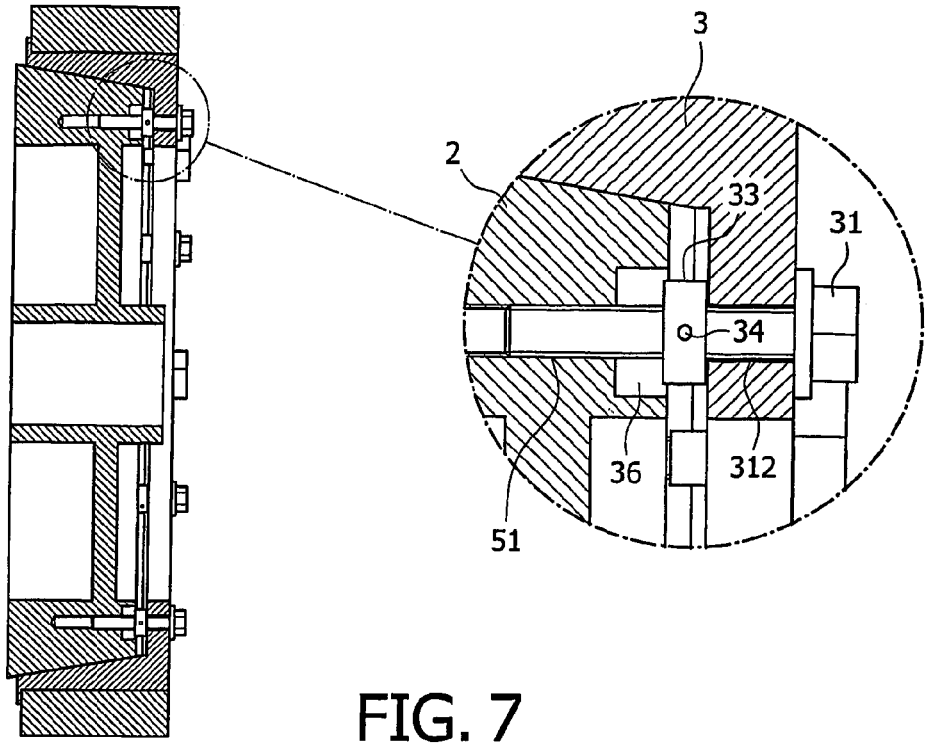
FIG. 7 is an expanded view of the transverse cross-section of the assembly as indicated in FIG. 1 with a detail of a hexagonal headed bolt disposed with ring elements.

FIG. 7 is an expanded view of the transverse cross-section of the assembly as indicated in FIG. 1. Shown in the expanded view is the cross-section of the hexagonal headed bolt, 31 (though any shape of head may be applied in practice) together with ring element 33 disposed with a hole 34 suitable for a cotter pin. Said bolt passes through a non-threaded hole 312 in the expandable outer ring 3, and the thread thereof engages with a threaded hole 51 in the inner wheel base 2. A recess 36 in the inner wheel base is present to accommodate the protruding ring element 33 attached to the bolt 31.

Figure 8:
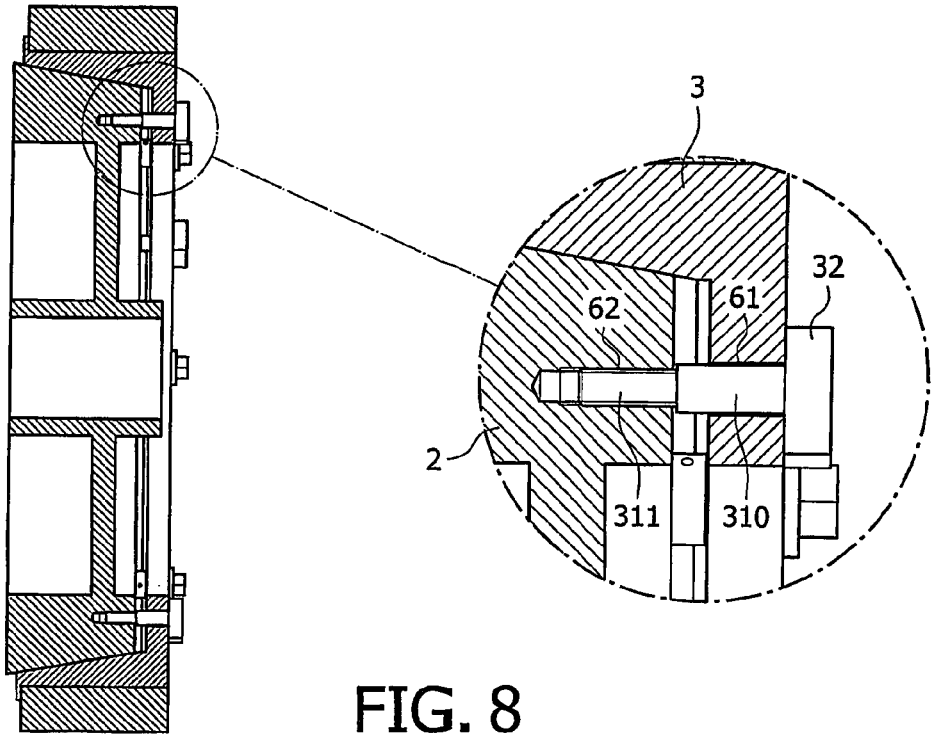
FIG. 8 is another expanded view of the transverse cross-section of the assembly as indicated in FIG. 1 with a detail of a square headed bolt.

FIG. 8 is another expanded view of the transverse cross-section of the assembly as indicated in FIG. 1. Shown in the expanded view is the cross-section of the square headed bolt, 32 (though any shape of head may be applied in practice), having a shaft which is partially threaded 311 and non-threaded 310. The shaft of the bolt passes through a hole 61 in the expandable outer ring 3, which does not engage the thread. A hole 62 in the inner wheel bases engages the thread of the bolt 311. Diameter of said hole 62 is such that the non-threaded portion of the shaft 310 cannot enter.

Figure 9:
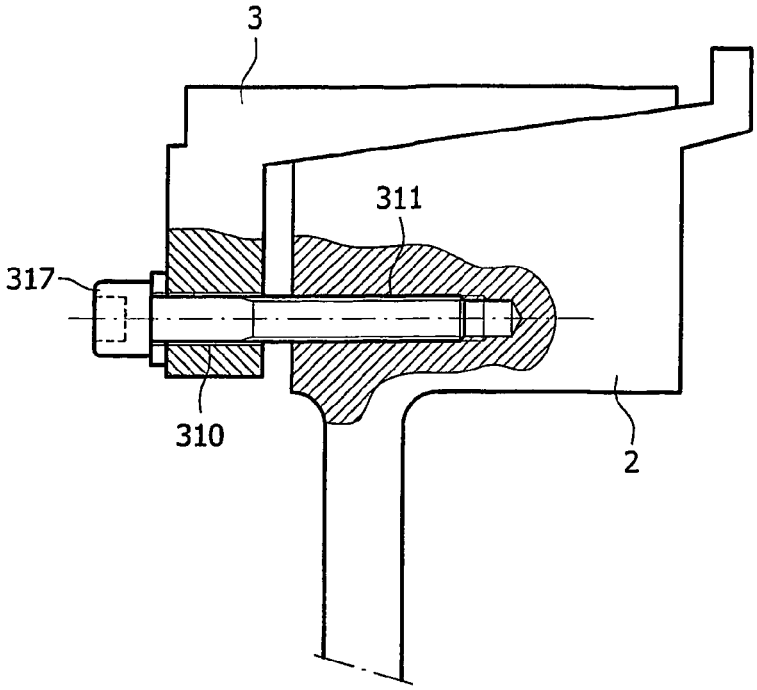
FIG. 9 is another cross section through a stop bolt, which is disposed with a hexagonal groove head.

FIG. 9 is expanded view of the transverse cross-section of the assembly according to the present invention. Shown in the expanded view is the cross-section of the stop bolt, 317 which head is round and disposed with an hexagonal recess shaped to receive an hexagonal key tool for tightening. The bolt shaft is partially threaded 311 and non-threaded 310. The shaft of the bolt passes through a hole in the expandable outer ring 3, which does not engage the thread. A hole in the inner wheel base 2 engages the thread of the bolt 311. The depth of the threaded hole in the wheel base 2 is such that when tightened up, the head of the bolt 317 in the tightened position does not sufficiently engage the outer ring 3 to cause expansion. The head of the bolt 317 prevents the outer ring 3 from completely disengaging from the wheel base 2. When the expandable outer ring expanded, the head of the bolt 317 stands proud of the plate of the expandable outer ring.

Figure 10:
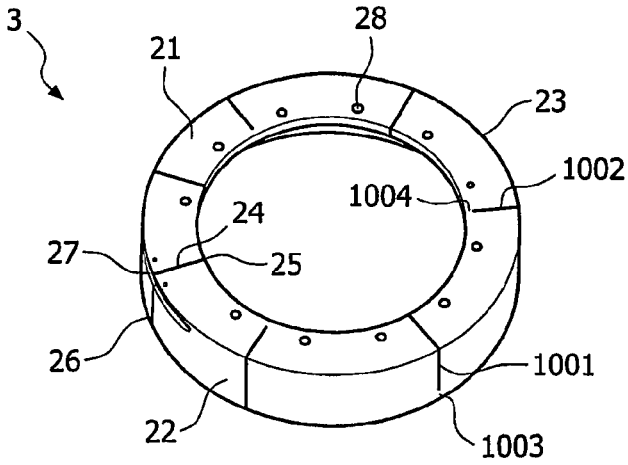
FIG. 10 is a view of an expandable outer cover provided with a single continuous slit, and a plurality of partial slits.

FIG. 10 shows an embodiment of an expandable outer ring as shown in FIG. 2*b*, further comprising a plurality of partial slits 1001, 1002 in additional to the single continuous slit 24. The partial slits are disposed roughly evenly around the periphery of the ring, running along the radial lines from the centre of the ring. The partial slits 1001, 1002 do not cut entirely across the expandable outer ring, but leave a hinging means 1003, 1004 that is a portion of uncut ring, towards the edge of the cylindrical surface 1003, or towards the edge of the plate 1004. The radial position of the hinging means 1003, 1004 alternates along the circumference of the ring.

What is claimed is:

1. A roller assembly for a production machine comprising:

an inner wheel base capable of attachment to a driving axle of a production machine, an expandable outer ring, formed from a single element, comprising a cylindrical outer surface and an inner rim, which ring is co-operatively connectable to said inner wheel base, whereby the circumference of said expandable outer ring is adjustable, wherein the expandable outer ring includes one or more holes each suitable for accommodating the shaft of a bolt and the inner wheel base is provided with one or more corresponding threaded holes suitable for engaging said bolt, wherein said outer ring is configured to mount an outer roller cover circumferentially around the cylindrical outer surface, wherein the expandable outer ring comprises one or more expansion slits, and wherein the outer surface of the expandable outer ring is eccentric with the inner rim of the expandable outer ring, such that said outer surface is concentric with the driving axle when said expandable outer ring is adjusted to secure the outer roller cover thereto.

2. The roller assembly according to claim 1 wherein the circumference of the expandable outer ring is adjustable dependent on the axial position of the expandable outer ring relative to the inner wheel base.

3. The roller assembly according to claim 1 wherein an outer surface of the inner wheel base comprises a conical shape.

4. The roller assembly according to claim 1 wherein the inner rim of the the expandable outer ring has an inner surface which is complementary to an outer surface of the inner wheel base.

5. The roller assembly according to claim 1 wherein:

said one or more holes of the expandable outer ring are each suitable for accommodating the shaft of a bolt, which is partially threaded, while not engaging the thread of said bolt;

a bolt is inserted into at least one hole in the expandable outer ring;

wherein tightening of the bolt draws the expandable outer ring towards the inner wheel base causing expansion of the expandable outer ring;

wherein loosening of the bolt releases the expandable outer ring from the inner wheel base, causing contraction of the expandable outer ring;

wherein tightening of the bolt draws the expandable outer ring towards the inner wheel base, without causing significant expansion of the outer ring, but causing sufficient expansion for the outer ring to engage the outer roller cover.

6. The roller assembly according to claim 5 further comprising one or more springs axially aligned between the expandable outer ring and inner wheel base.

7. The roller assembly according to claim 1 wherein the inner wheel base comprises a rim which determines the axial position of the roller cover.

8. The roller assembly according to claim 1 wherein the expandable outer ring comprises one or more protrusions which act as locating guides for locating the outer roller cover on the roller assembly.

9. The roller assembly according to claim 1, further comprising said outer roller cover mounted on the cylindrical outer surface of the outer ring.

10. The roller assembly according to claim 9 wherein the roller cover comprises at least two bonded layers comprising:

an inner layer made from a low- or non-elastic material; and an outer layer suited to the function of the roller.

11. The roller assembly according to claim 9 wherein the roller cover further comprises one or more apertures which act as locating guides for mounting the roller cover on the expandable outer ring.

12. The roller assembly according to claim 10 wherein the low or non-elastic material comprises reinforced glass fiber.

13. The roller assembly according to claim 10 wherein the outer layer comprises one or more elastomers.

14. The roller assembly according to claim 13, wherein said elastomers are any of the folowing: polyurethanes, rubbers, polyisoprene, polybutadiene, or polyisobutylene.

15. A method for changing a roller comprising the steps of:

a) providing a roller assembly according to claim 9;

b) when the work surface of the roller cover is worn, contracting the circumference of the expandable outer ring;

c) removing the worn roller cover;

d)replacing the worn roller cover with a new roller cover; and e) expanding the circumference of the expandable outer ring.

16. A method of manufacturing a roller assembly as defined in claim 1 comprising the steps of:

mounting the roller assembly onto a driving axle;

expanding the outer ring on the inner wheel base such that if an outer roller cover were present the outer roller cover would be secured to the roller assembly;

rotating the driving axle; and machining the outer ring to bring the outer surface of the outer ring into concentric alignment with the driving axle.

* * * * *